US006142366A

United States Patent [19]

Sagel

[11] Patent Number: 6,142,366

[45] Date of Patent: Nov. 7, 2000

[54] BREAKAWAY CONTAINER WITH THUMB SLIT

[75] Inventor: Joseph Paul Sagel, Highland Village, Tex.

[73] Assignee: Recot, Inc., Pleasanton, Calif.

[21] Appl. No.: 09/289,624

[22] Filed: Apr. 12, 1999

[51] Int. Cl.[7] ..... B65D 3/26

[52] U.S. Cl. ..... 229/201; 153/133.3; 229/101.2; 229/115; 229/235; 493/59; 493/160

[58] Field of Search ..... 229/101.1, 101.2, 229/4.5, 115, 201, 235; 53/133.3, 133.8; 493/59, 60, 160, 161, 240, 241, 340, 341, 355

[56] References Cited

U.S. PATENT DOCUMENTS

| | | | |
|---|---|---|---|
| 395,243 | 12/1888 | Maggi . | |
| 397,475 | 2/1889 | Tiffany . | |
| 1,560,681 | 11/1925 | Fisher . | |
| 1,751,755 | 3/1930 | Paris | 229/101.2 |
| 1,815,800 | 7/1931 | Respess . | |
| 1,932,169 | 10/1933 | Allen et al. . | |
| 2,145,430 | 1/1939 | New | 229/101.2 |
| 2,465,597 | 3/1949 | Marsh . | |
| 2,852,179 | 9/1958 | Bieler . | |
| 2,896,837 | 7/1959 | Risucci | 229/101.2 |
| 2,969,902 | 1/1961 | Cage | 229/101.1 |
| 2,972,407 | 2/1961 | Taylor | 229/101.1 |
| 4,091,929 | 5/1978 | Krane . | |
| 4,160,894 | 7/1979 | Stemmler et al. | 493/340 |
| 4,621,736 | 11/1986 | Roccaforte . | |
| 4,740,163 | 4/1988 | Kuchenbecker | 493/60 |
| 5,626,250 | 5/1997 | Dorazio . | |
| 5,704,539 | 1/1998 | Ljungstrom et al. | 229/101.1 |

FOREIGN PATENT DOCUMENTS

| | | | |
|---|---|---|---|
| 1551299 | 8/1979 | United Kingdom | 229/101.1 |

*Primary Examiner*—Gary E. Elkins
*Attorney, Agent, or Firm*—Carstens, Yee & Cahoon; Colin P. Cahoon

[57] ABSTRACT

An improved breakaway container for food and other perishable products comprising a simple construction and reliable breakage mechanism using a thumb cut scoring. By applying pressure to the thumb cut scoring, a tear is initiated in a circumferential scoring, thereby allowing for the separation of excess container wall from the container.

29 Claims, 2 Drawing Sheets

BREAKAWAY CONTAINER WITH THUMB SLIT

BACKGROUND OF THE INVENTION

1. Technical Field

The present invention relates to a rigid container or canister suitable for storing food products. The container has a plurality of breakaway sections which can be removed in order to reduce the size of the container as the product is consumed. The separation of the sections is initiated by applying pressure to a "thumb cut" score line.

2. Description of Related Art

The desirability of constructing food containers that can be selectively reduced in size as the product contained therein is removed has long been recognized in the food processing industry. Containers that can be reduced in size offer a number of benefits. For example, it is often beneficial to reduce the headspace in a container as the food product therein is consumed. By reducing this headspace, products can be maintained in a fresh state longer and are more securely contained, thus lessening the possibility that the product will be damaged if the container is dropped or mishandled. Reducing the size of the container also reduces the storage space required for such container. Depending on the container shape, it may also be desirable to reduce the distance from the container's opening to the product contained therein. This is often the case when the container in question is not large enough to easily accommodate the human hand. As more of the product is consumed, it becomes necessary to pour the product out in order to gain access to it. By shortening the size of the container as a product is consumed, a consumer may remove the product directly without the necessity of pouring it out of the container. Another benefit of containers that can be successively shortened is that such containers provide a quick visual indication of the amount of product remaining in the container.

Several designs have been developed to address the desirable goal of constructing a container which can be made progressively smaller, thereby reducing the excess headspace. For example, U.S. Pat. No. 5,626,250 issued to Dorazio on May 6, 1997, ("Dorazio '250") discloses a container apparatus having a main wall section that can be selectively and repeatedly perforated at different regions to form a plurality of detachable wall sections. These sections can be detached and discarded to reduce the size of the container. U.S. Pat. No. 4,621,736 issued to Roccaforte on Nov. 11, 1986, ("Roccaforte '736") discloses a carton having an upper body portion severable and removable from the lower body portion which can then form a closure cap applied to the lower body portion to re-close the container. U.S. Pat. No. 4,091,929 issued to Krane on May 30, 1978, ("Krane '929") discloses a cylindrical container with axial peripheral rip-strips for shortening the height of the container. U.S. Pat. No. 2,852,179 issued to Bieler on Sep. 16, 1958, discloses a container incorporating a tear tape for tearing-away and shortening the container. Likewise, U.S. Pat. No. 1,815,800 issued to Respess on Jul. 21, 1931, discloses a container with a plurality of compartments that are detachable by use of cutting strings.

Although the general concept of a breakaway container which can be made progressively smaller is certainly prior art, new designs are constantly attempted in order to increase the reliability of the tear mechanism and decrease the complexity and cost of manufacture. One of the drawbacks of the containers listed above is the use of a rip-string or similar mechanism involving pulling to initiate and complete the tear around the circumference of the container. For example, Dorazio '250 discloses a pull tab connected to a perforating member embedded onto a strip member for this purpose. A similar tear strip is disclosed in the Roccaforte '736 patent. Likewise, Krane '929 discloses a rip-strip which initiates tearing when pulled away from the container. All of these mechanisms involve tabs that are grasped by the fingers and then pulled outward and away from the container in order to initiate a tear. With any product that involves some pulling mechanism, this mechanism may break before a section has been completely torn away or may pull away from the container before accomplishing the desired tearing. In addition, the use of this type of pulling mechanism typically involves a construction requiring a string located interior to the container which can be ripped through the wall of the container or some similar mechanism that can ensure that the entire container wall is severed by pulling on some feature on the exterior of the container. These designs necessarily add to the complexity and cost of the manufacture of the container compared to a container without such features.

Accordingly, a need exists for a relatively simple design of a breakaway container that incorporates a reliable severing mechanism while adding little to no complexity to the manufacturing requirements of the container. Ideally, a food container package consists of two basic layers, an inner barrier layer, usually aseptic, and an outer covering layer which provides rigidity and a surface for applying product identifying marks and marketing features. A need exists for incorporating breakaway features into such elementary container design without adding any additional material required to initiate the break and yet maintaining reliable and repeatable severability. Such a design should be simple and inexpensive to manufacture and intuitively functional to the consumer.

SUMMARY OF THE INVENTION

The proposed invention comprises a breakaway rigid container for snacks and other perishable foods. One embodiment comprises a cylindrical container having an outer layer of cardboard, an inner layer of aluminum foil, a permanent cap on one end, and a removable cap on the opposite end. During manufacture, the cylindrical container is scored with a laser at two equidistant locations about the circumference of the container. This circumferential scoring cuts through the cardboard layer of the container while leaving the aluminum layer intact. Further, two "thumb cuts" are scored through the cardboard layer such that this scoring starts at an adjacent circumferential scoring and proceeds perpendicular to the circumferential scoring for approximately one-half inch toward the removable cap side of the container. The thumb cuts allow the consumer to press down on the exterior of the container at the thumb cut scoring, thereby initiating the breakage of the container about the circumferential scoring. The removable cap can then be placed over the remaining portion of the container, thus reducing the headspace in the container and providing the consumer with a visual indication of the approximate amount of product remaining in the container. The invention is simple and inexpensive to manufacture, provides a reliable severing mechanism, and is easy to use for the consumer.

The above as well as additional features and advantages of the present invention will become apparent in the following written detailed description.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Figure 1:
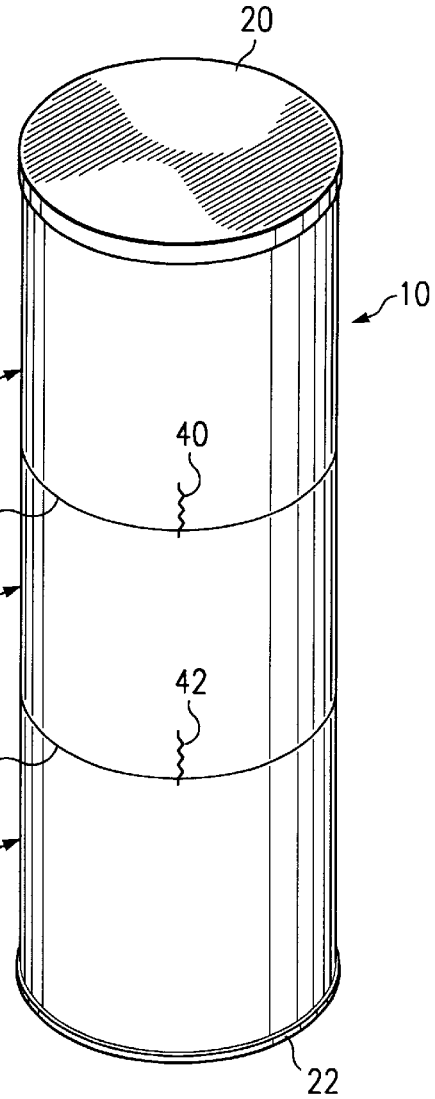
FIG. 1 is a perspective view showing a cylindrical embodiment of the invention.

FIG. 1 shows a perspective view of a cylindrical embodiment of the present invention. The major components of this cylindrical embodiment are a body or tube 10, a removable cap 20 at one end of the tube 10, and an end cap 22 permanently attached to the opposite end of the tube 10. The removable cap is preferably of a plastic construction, covers the mouth of the container, and can be transparent to allow a consumer to view the contents of the container without removing the cap 20. The container can also be initially sealed with a removable, tamper-proof membrane or seal (not shown) which is placed over the mouth of the container after the container has been filled with a food product in order to provide an air-tight seal. The tamper-proof seal can be constructed of aluminum foil, polypropylene, or other suitable material and is torn away from the mouth of the container by a pull tab or like mechanism well known in the food packaging industry. The removable cap 20 acts as the means for sealing the mouth of the container once the tamper-proof seal is removed. The end cap 22 is permanently affixed to the tube 10 and is typically constructed of aluminum or some other rigid material, thereby providing strength and crush resistance to the container.

The embodiment shown is approximately nine inches in length measured from the end cap 22 to the removable cap 20. The container is divided by two score lines 30, 32 which divide the tube 10 into three separate sections 12, 14, 16 of approximately equal length. The length of the individual sections 12, 14, 16 can vary depending on the geometry of the body 10 and the product stored therein. For example, a tube 10 having an internal diameter of three inches is suitable for the packaging of a stacking potato chip product. Consumer studies have shown that a tube shaped container with such diameter is only wide enough to allow the consumer to place his hand far enough into the container to reach the product located within about three inches of mouth of the container. Once the product has been consumed such that the level of the product in the container is more than about three inches from the mouth of the container, it is necessary for the consumer to pour the product out of the container, rather than removing the product, as is sometimes desired, by inserting the consumer's hand into the container. Consequently, in such embodiment, it is desirable to maintain the product within three inches of the mouth of the container regardless of the amount of product consumed. A container that has three inch sections 12, 14, 16 that can be removed, while allowing for the re-sealing of the container, is ideally suited for this purpose.

The breakaway feature of the container is accomplished by the use of thumb cuts 40, 42 in combination with the circumferential score lines 30, 32. The construction of the thumb cuts 40, 42 and score lines 30, 32 will be described in further detail below in conjunction with FIG. 4. It is important to note at this juncture, however, that the thumb cuts 40, 42 are generally perpendicular to the score lines 30, 32 and are located on the portion of a corresponding section 12, 14 which will be disposed of when the section 12,14 is removed.

Figure 2:
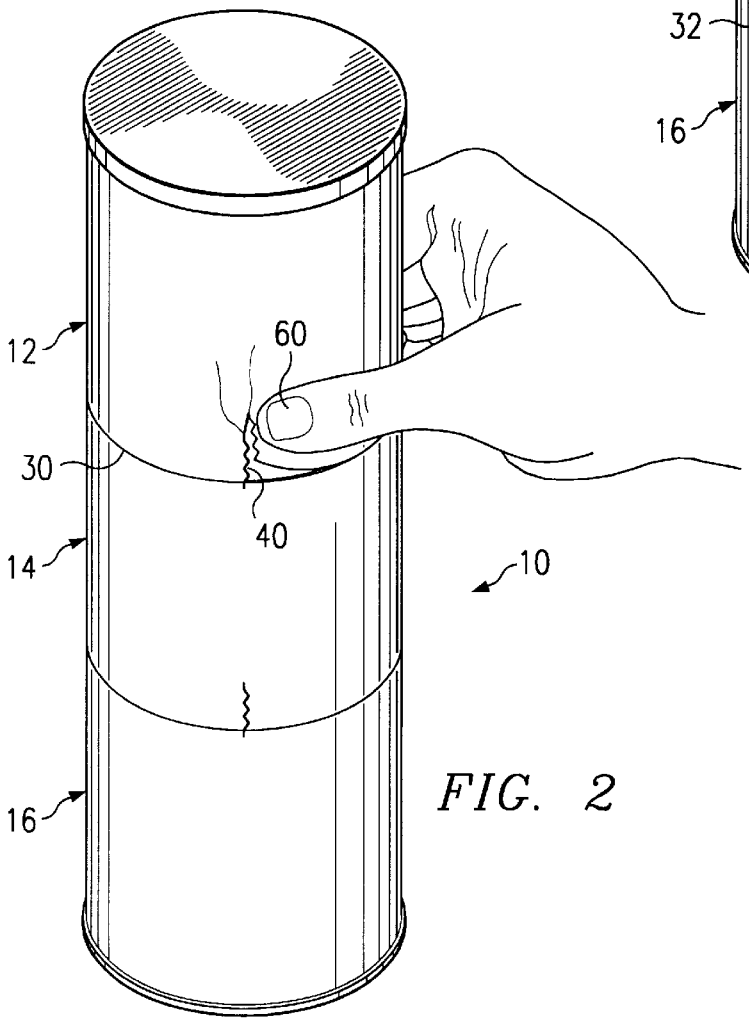
FIG. 2 illustrates the breakaway feature of a cylindrical embodiment of the invention.

The breakaway functionality is illustrated in FIG. 2. Corresponding reference numerals are used to represent corresponding elements throughout this disclosure unless otherwise indicated. FIG. 2 shows the mechanics involved in breaking away the upper most section 12 from the container. The tube 10 is grasped by the consumer's hand such that the tip of the consumer's thumb 60 is placed in the vicinity of the corresponding thumb cut 40. Pressure is then applied to the thumb cut 40 with the thumb 60 in order to initiate a tear along the associated score line 30. By orienting the thumb cut 40 above the score line 30, the remainder of the tube 10, consisting of the lower two sections 14, 16, is not exposed to the pressure applied to initiate the tear. This orientation of the thumb cut 40 results in the upper-most section 12 being deformed. However, the adjacent middle section 14 retains its shape, because it is not subjected to the potential damage from the pressure applied by the consumer's thumb 60. Once the tear is initiated, the upper-most section 12 is torn away from the remainder of the container while the tear continues to propagate about the score line 30.

Figure 3:
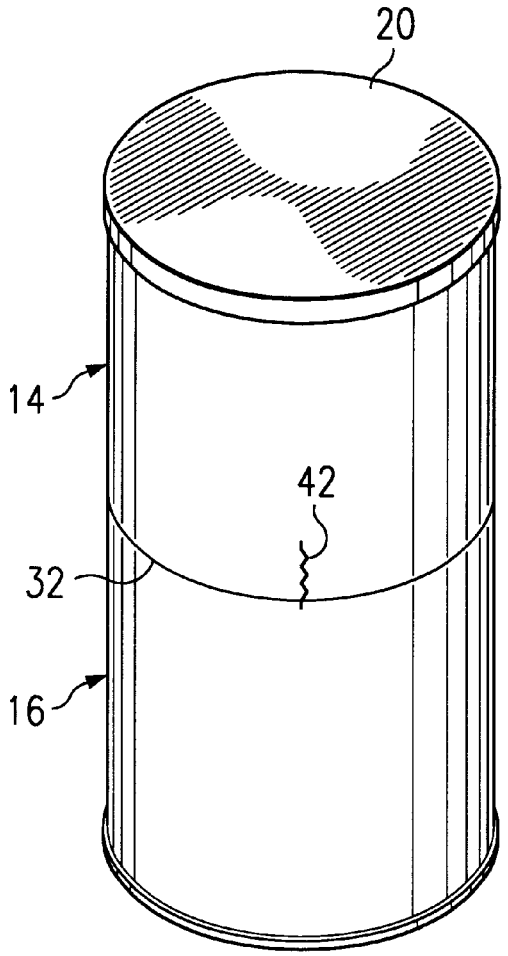
FIG. 3 is a perspective view of a cylindrical embodiment of the invention after the upper-most section has been removed; and, FIG. 4 is an end view of a cut-away portion of one section of the invention showing a two layer construction.

After the upper-most section 12 has been completely removed from the remaining sections 14, 16 of the container, the removable cap 20 can be placed at the new mouth of the container, as illustrated in FIG. 3. The entire process can be repeated after additional product has been consumed by applying pressure to the remaining thumb cut 42 and propagating a tear between the middle section 14 and the lower section 16 along the dividing score line 32. The removable cap 20 can then be placed over the open end of the lower section 16. The removable cap 20 can be of a female over cap design, a male plug design, or a combination of the two.

The shortening of the container after the product has been consumed helps maintain a fresher product by reducing the headspace between the product remaining in the container and the removable cap 20. Further, the shortening of the container provides the consumer with a quick visual reference of the approximate amount of product remaining in the container. In addition, the container takes up less storage space after each section is removed.

Figure 4:
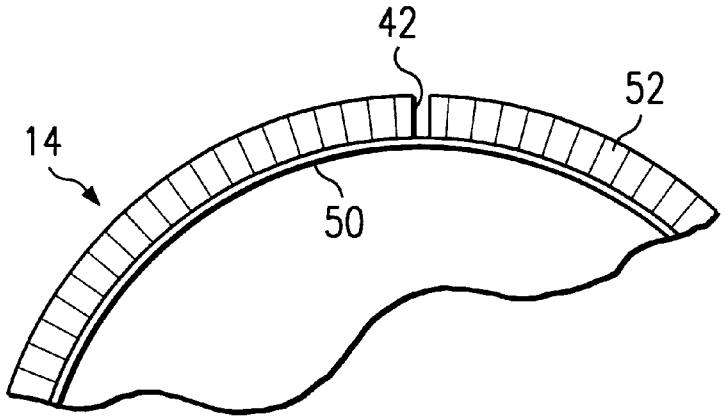

FIG. 4 shows an end view of a portion of the middle section 14 of the cylindrical embodiment of the invention after the middle section 14 has been torn away from the lower section 16. FIG. 4 thus provides a view illustrating the basic construction of the tube 10. The tube portion 10 of the container in this embodiment is constructed of two basic layers 50, 52. The inner layer 50 is preferably an impermeable oxygen barrier constructed of a material, such as aluminum foil, metalized polypropylene, or metalized polyesters, which will allow for an air-tight seal within the container when combined with the end cap 22 and the removable cap 20 or tamper-proof seal discussed above. Aluminum foil in the thickness of approximately 0.0028 inches has been found to be a particularly suitable material. The inner layer 50 can also comprise a separate sealant coating, such as polypropylene or other suitable material, which is applied to the inner surface of the inner layer 50.

The inner barrier layer 50 is enclosed by an outer layer 52. The outer layer 52 is constructed of material (which can be multi-layered) that provides both rigidity to the container and a surface for the application of product and marketing information, such as a paper board based cardboard with an exterior plastic-based label cover or a paper label cover. Another example of an appropriate outer layer 52 material is polypropylene. The two basic layers 50, 52 are attached during construction by an adhesive.

The score line 32 and thumb cut 42 are formed by scoring the outer layer 52 but not the barrier layer 50. This can be accomplished simply and economically due to the recent development of laser cutting technology, such as the laser cutting devices manufactured by Laser Machining, Inc. of Somerset, Wis. Pulses of a laser energy can be directed towards the exterior of the container to form the score line 32 and thumb cut 42. Pulses from a laser cutting tool intermittently cut the outer layer 52 of the container about the container's circumference, thereby forming the circumferential score line 32. The same technique is used to form the thumb cut 42. The laser energy is sufficient to cut completely through the outer cardboard layer 52, but is refracted by the inner aluminum barrier layer. Traditional mechanical cutting tools can also be used, but may not provide a consistently uniform and repeatable scoring pattern when compared with the new laser technology.

The embodiment illustrated involves a cylindrical tube body 10. However, it should be understood that the invention could also comprise any number of shapes. For example, a triangular geometry could be used for the body 10 portion of the container in order to accommodate stackable tortilla chips. A square or rectangular geometry could be used to accommodate square crackers or other similar products. Likewise, it may be desirable to construct an oval geometry for the container body 10, as opposed to circular, to more closely approximate to the shape of stacking potato chips. Further, any number of removable sections 12, 14, 16 can be constructed in combination with variations of the container's overall length and diameter.

While the invention has been particularly shown and described with reference to a preferred embodiment, it will be understood by those skilled in the art that various changes in form and detail may be made therein without departing from the spirit and scope of the invention.

What is claimed is:

1. A container for food products comprising:

an inner layer;

an outer layer adhered over the inner layer;

at least one perimeter score line through the outer layer; and a score cut extending generally perpendicular from said at least one perimeter score line.

2. The container of claim 1 wherein said container comprises a generally cylindrical shape.

3. The container of claim 1 wherein the inner and outer layers form a generally triangular shape.

4. The container of claim 1 wherein the inner and outer layers form a generally rectangular shape.

5. The container of claim 1 wherein said score cut extending generally perpendicular from said perimeter score line is approximately one-half inch in length.

6. The container of claim 1 wherein said inner layer comprises aluminum.

7. The container of claim 1 wherein said outer layer comprises cardboard.

8. The container of claim 1 wherein said score line and score cut are formed by use of a laser.

9. The container of claim 1 further comprising an end cap affixed to a first end of the container and a removable cap affixed to a second end of the container.

10. The container of claim 9 wherein said score cut extending generally perpendicular from said perimeter score line extends in a direction towards the removable cap.

11. A breakaway food container comprising;

an inner barrier layer;

an outer layer affixed over said inner layer; and, wherein said outer layer is scored around a perimeter of the container in at least one location and is further scored away from the perimeter scoring a short distance.

12. The container of claim 11 wherein said container comprises a generally cylindrical shape.

13. The container of claim 11 wherein the inner and outer layers form a generally triangular shape.

14. The container of claim 11 wherein the inner and outer layers form a generally rectangular shape.

15. The container of claim 11 wherein said scoring away from the perimeter scoring extends generally perpendicularly from the perimeter scoring for a distance of approximately one-half inch.

16. The container of claim 11 wherein said inner layer comprises aluminum.

17. The container of claim 11 wherein said outer layer comprises cardboard.

18. The container of claim 11 wherein said outer layer is scored using a laser.

19. The container of claim 11 further comprising an end cap attached to a first end of the container and a removable cap attached to a second end of the container.

20. The container of claim 19 wherein the scoring away from the perimeter scoring extends generally perpendicularly from said perimeter scoring towards the second end of the container.

21. A method for manufacturing a breakaway container having an inner layer, an outer layer, and a mouth end, said method comprising the steps of:

a) scoring said container about its circumference at at least one location; and, b) scoring a line away from the circumference scoring towards said mouth end of said container.

22. The method of claim 21 wherein the container is a cylindrical tube.

23. The method of claim 21 wherein the container is triangular.

24. The method of claim 21 wherein the container is rectangular.

25. The method of claim 21 wherein the scoring of step (b) extends generally perpendicular from the scoring of step (a) for a distance of approximately one-half inch.

26. The method of claim 21 wherein step (a) comprises scoring the outer layer and not the inner layer.

27. The method of claim 26 wherein said inner layer comprises aluminum.

28. The method of claim 26 wherein said outer layer comprises cardboard.

29. The method of claim 26 wherein the scoring of steps (a) and (b) comprises using a laser cutting device.

* * * * *